US005341724A

United States Patent [19]

Vatel

[11] Patent Number: 5,341,724

[45] Date of Patent: Aug. 30, 1994

[54] PNEUMATIC TELESCOPING CYLINDER AND METHOD

[76] Inventor: Bronislav Vatel, 3730 Countryside La., Glenview, Ill. 60025

[21] Appl. No.: 82,494

[22] Filed: Jun. 28, 1993

[51] Int. Cl.[5] ..... F01B 7/20

[52] U.S. Cl. ..... 92/53; 91/1

[58] Field of Search ..... 92/5 R, 13, 51, 52, 92/53; 91/1

[56] References Cited

U.S. PATENT DOCUMENTS

| | | | |
|---|---|---|---|
| 191,516 | 6/1877 | Comines | 92/53 |
| 501,426 | 7/1893 | Kampf . | |
| 1,095,926 | 5/1914 | Powell | 92/53 |
| 2,933,070 | 4/1960 | Trumper et al. . | |
| 3,128,674 | 4/1964 | Ganchar et al. . | |
| 3,136,221 | 6/1964 | Walker . | |
| 3,259,027 | 7/1966 | Phillipson et al. . | |
| 3,279,755 | 10/1966 | Notenboom et al. . | |
| 3,934,423 | 1/1976 | Haller | 92/52 |
| 3,973,468 | 8/1976 | Russell, Jr. | 91/25 |
| 4,516,281 | 2/1985 | De Filippi | 92/52 |
| 4,516,468 | 5/1985 | Sheriff | 91/169 |
| 4,541,325 | 9/1985 | Sheriff | 92/52 |
| 4,567,811 | 2/1986 | Piegza et al. | 91/169 |
| 4,646,768 | 3/1987 | Tanaka et al. | 92/53 X |
| 4,936,193 | 6/1990 | Stoll | 92/51 |

FOREIGN PATENT DOCUMENTS

| | | | |
|---|---|---|---|
| 209497 | 7/1957 | Australia | 92/53 |
| 963750 | 4/1957 | Fed. Rep. of Germany | 92/53 |
| 1231194 | 12/1966 | Fed. Rep. of Germany | 92/53 |

*Primary Examiner*—Edward K. Look
*Assistant Examiner*—Hoang Nguyen
*Attorney, Agent, or Firm*—H. Jay Speigel

[57] ABSTRACT

A telescoping cylinder has a cylindrical housing (A) carrying a first stage including a central piston (B) opening into a hollow piston rod (C) and at least one succeeding stage including a concentric piston (E) and piston rod (F) having a hollow interior containing the central piston and piston rod with an air opening (H) in the concentric piston rod opening into an air outlet (G) at an exit end of the cylindrical wall. By applying compressed air to the central piston, the first stage is extended initiating movement of the concentric piston and piston rod with extension of the concentric piston and piston rod thereafter followed by extension of any succeeding stage. By applying compressed air to the outlet (G) the concentric piston (E) and piston rod (F) is retracted initiating movement of the central piston and piston rod when the air opening (H) in concentric piston rod (F) is aligned with port (G).

12 Claims, 4 Drawing Sheets

PNEUMATIC TELESCOPING CYLINDER AND METHOD

BACKGROUND OF THE INVENTION

This invention relates to pneumatic telescoping cylinders and method and more particularly to a compact apparatus which is of simple construction and inexpensive and easy to manufacture and use in a variety of ways.

Prior art pneumatic actuators include the disclosure of U.S. Pat. No. 4,525,999 wherein an internal gas generator is contained in an innermost tube of the telescoping cylinder. The tubes are automatically locked in position when fully extended. Other patents illustrating the state of the art include U.S. Pat. Nos. 501,426; 2,933,070; 3,128,674; 3,136,221; 3,259,027; 3,279,755; 3,934,423; 3,973,468; 4,516,468; 4,541,325; 4,567,811; and 4,726,281.

It will be observed from the above patents that telescoping cylinders have generally been hydraulically operated because of the complexity and cost involved in the production of air operated telescoping cylinders. Prior pneumatic and hydraulic telescoping cylinders have required enclosure of the exit ports when extended, and this limits the capacity to miniaturize or minimize the length of the telescoping cylinders when in retracted position, as well as limiting the number of stages and a stroke of each stage.

SUMMARY OF THE INVENTION

Accordingly, it is a important object of the present invention to provide a pneumatic telescoping cylinder of simple construction so as to minimize production cost and enhance the benefits of the device.

Another important object of the invention is to reduce the overall length of the pneumatic cylinder when retracted and to maximize the effective length when extended.

Another important object of the invention is to provide telescoping pneumatic cylinders having any number of desired stages resulting in a capacity for unlimited lengths utilizing standard material including tubes, seals and bushings which may be constructed of inexpensive material.

Another important object of the invention is to provide a structure for a telescoping pneumatic cylinder which has no special valving or moving ports and yet which is capable of being readily controlled as to stroke and having the capability of being used as a single or double acting cylinder.

Another important object of the invention is the provision of air openings serving as exhaust ports in the several stages which are open to the atmosphere when extended and which provide a path for exhaust air during extension of the several stages. The openings provide a path for inlet air during retraction of the several stages.

These and other objects of the invention are accomplished by providing a telescoping cylinder having several stages each including a hollow piston and piston rod opening toward an inlet end of the cylinder and substantially contained therein when retracted. An inner sealed bushing on the opposite end of the piston rod is used as a cylinder face cap. Air openings serving as exhaust ports are aligned to vent the voids between piston rods when sequentially extending the several stages.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a collapsible telescoping cylinder extensible responsive to the application of air under pressure including a cylindrical housing A having an external cylindrical wall and an end cap closing one end of the cylindrical wall. A central piston B has a central opening and faces the end cap on one side. A central hollow piston rod C extends outwardly from the central piston opposite the end cap in axial alignment with the central opening and with the cylindrical wall. An air inlet or first port D at an entrance end of the cylindrical wall communicates with a face of the central piston and piston rod opposite the end cap. A concentric piston E and piston rod F has a hollow interior portion containing the central piston and piston rod respectively. The central piston carries the piston rod to extended position initiating movement of the concentric piston and piston rod subjecting a face of the concentric piston to inlet air pressure. An air outlet or second port G is provided at an exit end of the cylindrical wall. An air opening H is the concentric piston rod opening into the air outlet for delivering air from the hollow in the concentric piston and piston rod into said air outlet. Thus, the central piston and central rod are extended followed by extension of the concentric piston and concentric piston rod from the cylindrical wall.

Figure 1:
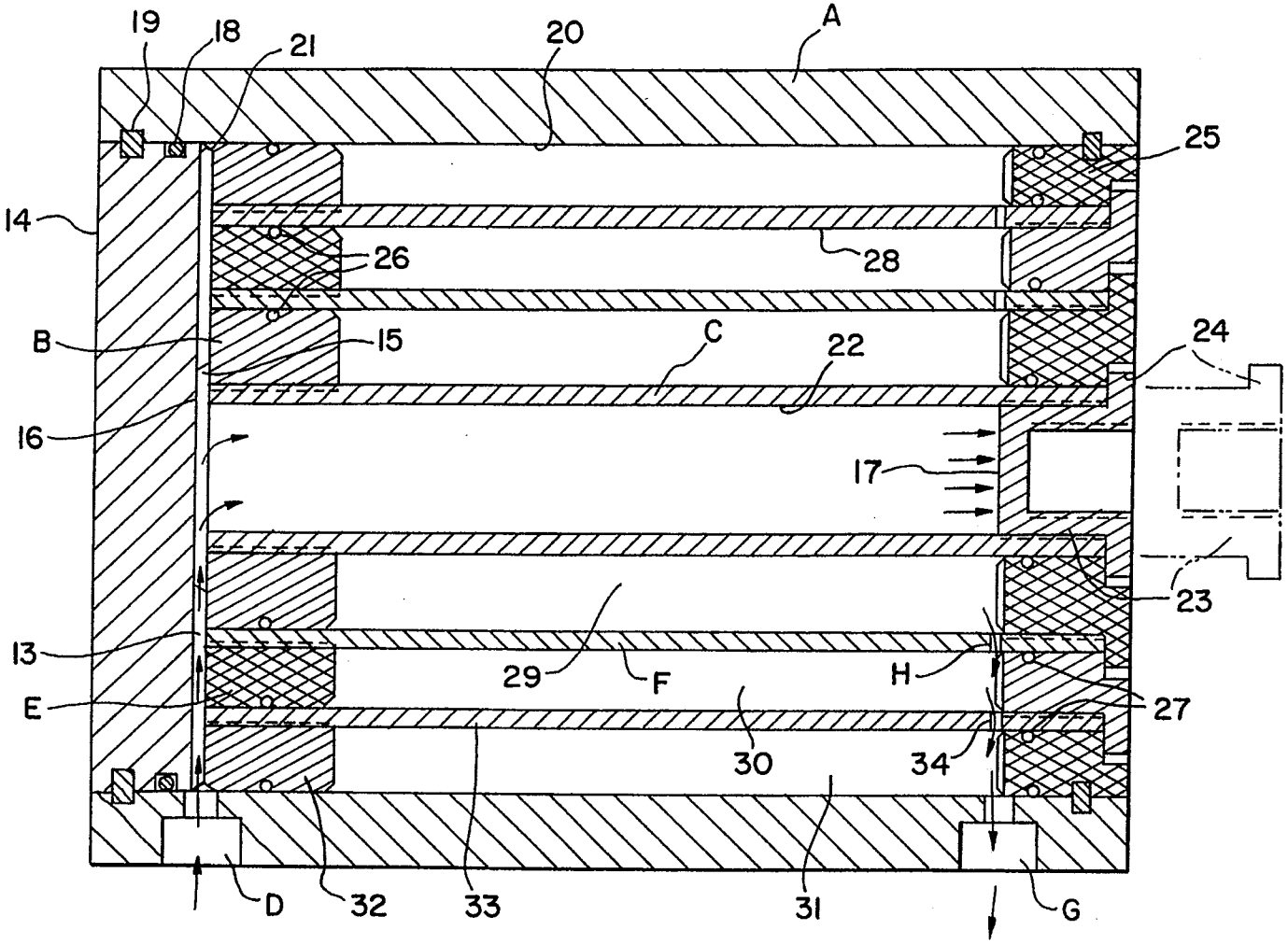
FIG. 1 is a longitudinal sectional elevation illustrating a pneumatic telescoping cylinder constructed in accordance with the present invention when in fully retracted position.
Figure 2:
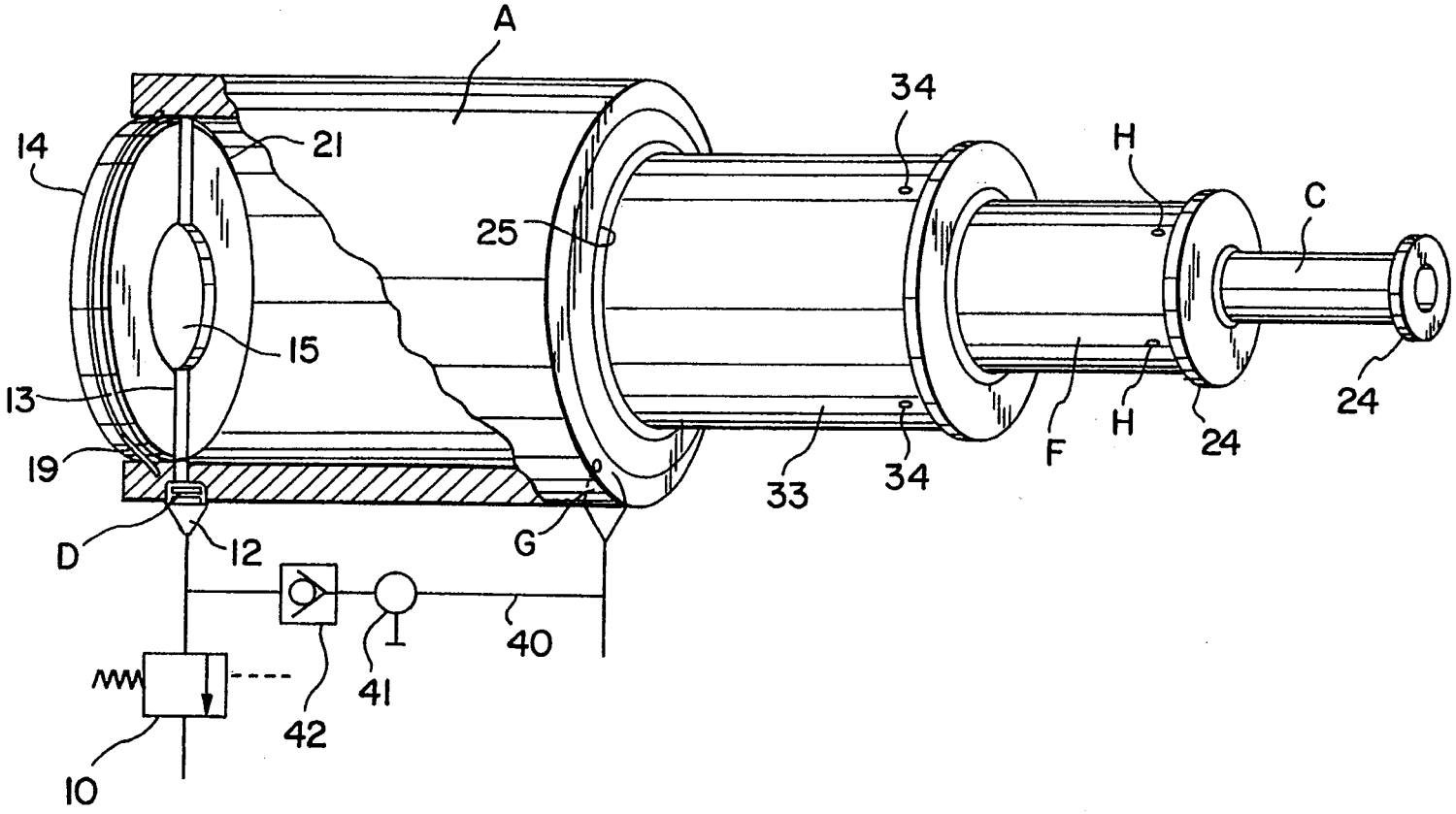
FIG. 2 is a perspective view with parts broken away illustrating a pneumatic telescoping cylinder constructed in accordance with the present invention in fully extended position.

The steps in extending the pneumatic telescoping cylinder include the application of compressed air from a suitable source (not shown) through a control valve (not shown) to a nipple 12 carried within the air inlet D as best observed in FIGS. 1 and 2. The central piston B and hollow piston rod C which extends therefrom is the first to move, because air is supplied through grooves 13 in the end cap 14 to a central recess 15 which exposes a portion 16 of the face of the central piston B to the force exerted by the pressurized air.

It will be observed in FIG. 1 that in addition to the face of the piston exposed to the pressurized air a face 17 at the outer end of the hollow piston rod C is also exposed to the force of the pressurized air (FIG. 1).

Referring more particularly to FIGS. 1 and 2, the end cap 14 is provided with an O-ring 18 which acts as a seal and a retaining snap ring 19 which acts to retain an end cap within the inner cylinder wall 20 of the cylindrical housing A. A chamfer 21 is provided in an inner face of the end cap so that the grooves 13 need not be aligned with the air inlet D in order to provide air under pressure to the central piston and hollow piston rod for extending same as well as to succeeding pistons and piston rods during the operation of extending the several stages as desired.

It will be observed that the central piston B and piston rod C are illustrated as having a cylindrical hollow interior 22 which terminates at an end remote from the piston B as at the face 17 of the terminating wall. The terminal portion of the piston rod C includes an integral cylindrical plug 23 which has a flange 24 adjacent an outer end thereof. FIG. 1 illustrates the cylindrical end 23 as having been extended just beyond an outer end of the housing A.

The outer end of the housing A is illustrated as including a terminal inwardly extending front cap 25 defining an end wall which contains the terminal portions of succeeding stages of the assembly in nesting relation providing a seal or end cap arrangement at the end of the housing A remote from the aligned pistons which are also in sealed relation because of the respective O-rings 26. O-rings 27 provide a seal between the cylindrical ends of the several hollow piston rods at the remote or exit end of the housing A.

Figure 3:
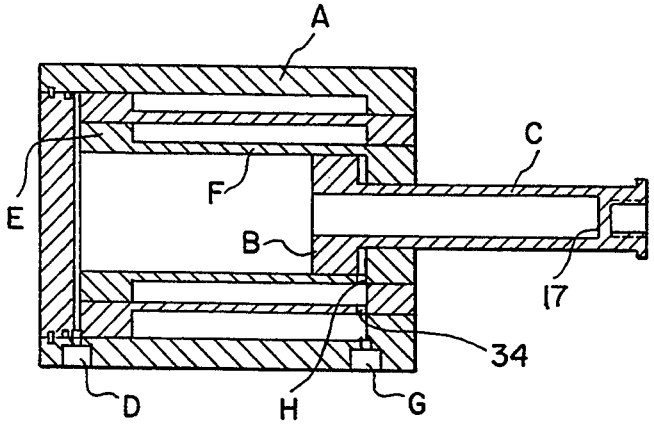
FIG. 3 is the first of three stage drawings illustrating the parts during extension in sequence with a central cylinder and piston rod being extended first.

After the central piston B and associated piston rod C are fully extended as at FIG. 3, the further application of air pressure which extends across the entire inner face of the piston B as well as the terminal face 17 causes initial movement of the next succeeding stage which is constituted by a concentric piston E and piston rod F which are hollow as illustrated at 28 for containing the central piston and piston rod.

It will be observed that an air opening H is provided in an outer wall of the piston rod F adjacent the exit end of the housing A so as to communicate through succeeding air openings in the outer walls of the piston rods of succeeding stages with the air outlet G at the remote end of the cylinder housing A. The succeeding piston rods form donut shaped voids 29, 30 and 31. A piston 32 and associated piston rod 33 of a final stage are illustrated as having an air opening 34 therein communicating with the air outlet G. Thus, during extension of the several stages air flows first through the openings H during extension thereof from the void 29 into the void 30. During extension of the next stage air through openings 34 flows into the void 31 and thence into the air outlet G.

Figure 4:
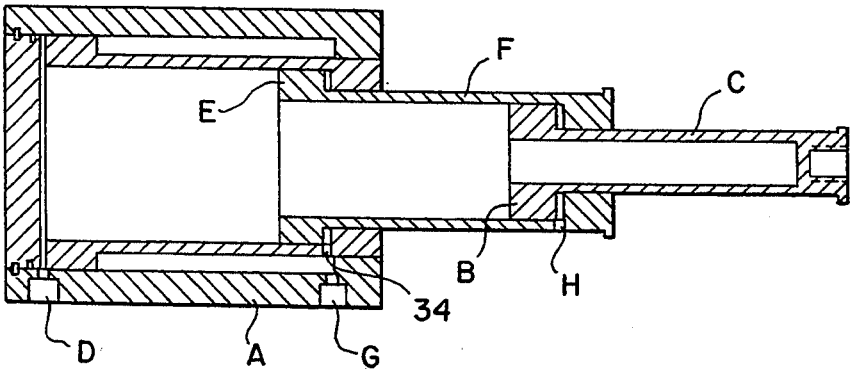
FIG. 4 is a stage drawing illustrating a concentric piston and piston rod constituting a second stage in extended position.
Figure 5:
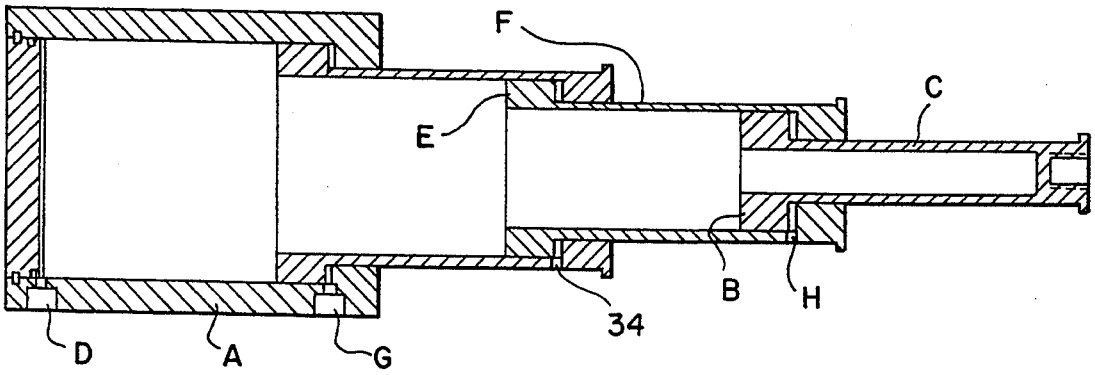
FIG. 5 is a stage drawing illustrating the last of the succeeding stages contemplated in the present embodiment in the extended position.

During retraction pressurized air is applied to what was formally the exhaust port G while the port D serves as the exhaust port. The final stage retracts first with the piston 32 and piston rod 33 being returned to seated position against the end cap 14 (FIG. 4). This is followed by succeeding stages until they are returned to retracted position as illustrated in FIGS. 3 and 1.

Openings 34 in the piston rod 33 are exposed to the air pressure in cavity 31 and provide the path for compressed air to retract piston E and piston rod F to seated position against the end cap 14. Openings H in the piston rod F are exposed to the air pressure in cavity 30 and provide the path for compressed air to last stage to seated position against the end cap 14.

The apparatus is capable of operating in the mode of a single acting cylinder when oriented so as to face upwardly. Pressurized air is used to extend the several stages while gravity is used to retract them. By releasing air from the entrance port D, the first stage retracts first and thereafter succeeding stages until the parts are returned to retracted position illustrated at FIG. 1. The single acting mode also contemplates utilizing the telescoping cylinder as being oriented in a position facing downwardly wherein pressurized air is applied to the port G in order to retract, whereas gravity is utilized for extending the several stages. The inlet port D is used as a vent or exit port with extension and retraction occurring in the same sequence as that described for the double acting mode first described above. Flanges 24 (FIG. 2) prevent the falling rods F or C from passing into succeeding one, if the cylinder is extended and port D serves as the exhaust port.

The central piston rod C is hollow to reduce rod weight and for conversion to a concentric piston rod for smaller central piston; serve as internal air accumulator for air spring extending of single acting cylinders; and to provide space for a line or an apparatus for telescoping cylinders with a programmable stroke.

When utilizing the apparatus as an air spring as for purposes of returning the several stages of single acting cylinder into extending position as illustrated in FIG. 2, pressurized air is first applied to the port G to retract the cylinder while the air spring mode will be utilized to extend the stages.

Referring to FIG. 2, the inlet port G is connected to the outlet port D through the line 40 which contains a pressure regulator 41 and a check valve 42. Thus, pressure is maintained C and the piston E and piston rod F, and the piston 32 and piston rod 33 when the inlet port G is used as an exhaust port. Because of the compressibility of the air, the pressure in the cavity 22 is not sufficient to restrict retraction of the respective piston and piston rod, if a pressure relief valve 10 releases excess air pressure resulting from the retraction of the respective stages.

If necessary, when utilizing the air spring configuration for purposes of retracting several stages of a single acting cylinder, a separate accumulator may be utilized in order to provide a sufficient volume of air for carrying to the manipulation of the respective stages.

Figure 6:
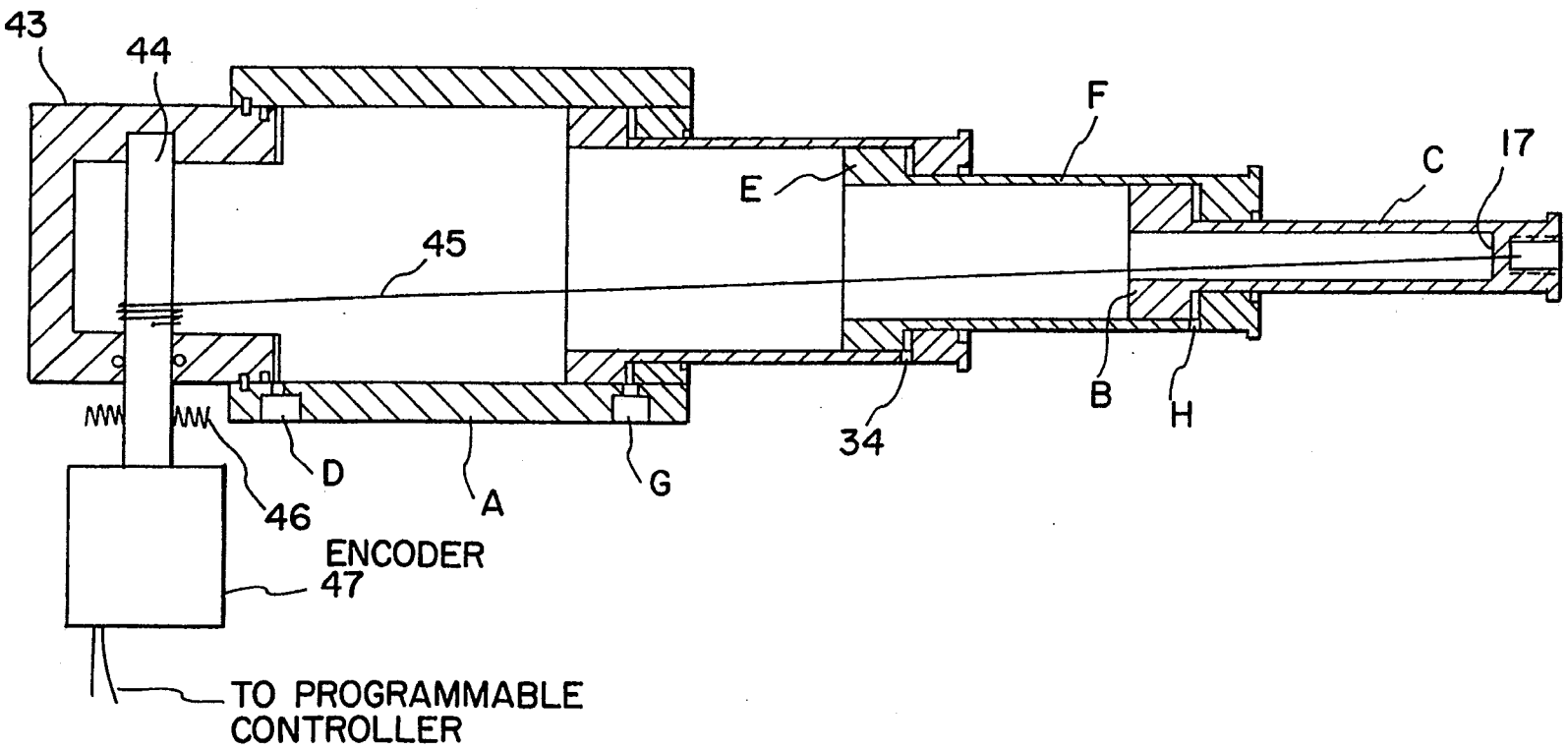
FIG. 6 is a longitudinal sectional elevation illustrating a pneumatic telescoping cylinder utilizing a stroke control mechanism.

When utilizing a stroke control mechanism as for purposes of automatic measurement, monitoring, programming and control of the cylinder stroke, an end cap 43 is used, shown on FIG. 6. The cap includes rotating air sealed control shaft 44 with wound metal string 45. One end of said string is fixed to said shaft, another end is fixed to the plug 17 of the central piston rod. The shaft is spring 46 loaded in order to maintain a constant tension of the strand 45. This makes the shaft 45 rotatable responsive to any movements of the central piston rod C. An encoder 47 mounted to said shaft 44 can transmit this information to a programmable controller (not shown) for immediate execution.

While a preferred embodiment of the invention has been described using specific terms, such description is for illustrative purposes only, and it is to be understood that changes and variations may be made without departing from the spirit or scope of the following claims.

What is claimed is:

1. A double acting telescoping cylinder extensible and collapsible responsive to the application of air under pressure, comprising:

a housing having an external cylindrical wall;

an end cap closing one end of said cylindrical wall;

a central piston having a central opening facing said end cap;

a central hollow piston rod extending outwardly from said central piston away from said end cap in axial alignment with said central opening and with said cylindrical wall and terminating at a terminating wall having a face remote from said central piston and facing said end cap;

a first port through a first end of said cylindrical wall adjacent said end cap communicating with said central piston, central hollow piston rod and terminating wall face;

a concentric piston and concentric piston rod having a hollow interior portion containing said central piston and central hollow piston rod respectively;

said central piston carrying said central hollow piston rod to extended position remote from said end cap whereupon movement of said concentric piston and concentric piston rod is initiated through exposure of a face of said concentric piston facing said end cap to air pressure from said first port;

said external cylindrical wall terminating at an end wall remote from said end cap, said end wall extending radially inwardly with respect to an inner cylindrical surface of said external cylindrical wall, said end wall having an end wall face facing said end cap;

a second port through said external cylindrical wall, said second port extending perpendicular to said end wall face and straddling said end wall face;

an air opening in said concentric piston rod aligned with said second port when said concentric piston is retracted and adjacent said end cap for connecting said hollow interior portion in said concentric piston and piston rod with said second port;

whereby application of air pressure to said first port causes said central piston and central piston rod to be extended followed by extension of said concentric piston and concentric piston rod from the cylindrical wall, and whereby application of air pressure to said second port causes retraction of the concentric piston and concentric piston rod followed by retraction of said central piston and central piston rod toward said end cap.

2. The structure set forth in claim 1, wherein at least one additional concentric piston and at least one additional concentric piston rod are provided between said concentric piston and concentric piston rod, on the one hand, and said external cylindrical wall, on the other hand.

3. The structure set forth in claim 1, wherein said end cap has a groove communicating with said first port delivering air to a central recess in said end cap facing said central cylinder and piston rod.

4. The structure set forth in claim 1, wherein said terminating wall is formed on a cylindrical front end cap fitted inside of said central hollow piston rod, said cylindrical front end cap having a radially outwardly extending flange extending radially outwardly beyond said central hollow piston rod, said flange nesting within an annular recess formed in a concentric end cap mounted on said concentric piston rod.

5. The structure set forth in claim 4, wherein said cylindrical front end cap has a distal face, said concentric end cap having a concentric distal face, said distal face and concentric distal face being coplanar when said radially outwardly extending flange is nested within said annular recess.

6. The structure set forth in claim 4, wherein said concentric end cap has an inner annular wall in slidable engagement with said central hollow piston rod, said inner annular wall having an annular seal mounted therein and sealingly engaging said central hollow piston rod.

7. The structure set forth in claim 4, wherein said radially outwardly extending flange and said annular recess interact to form a limit stop preventing retracting movement of said cylindrical front end cap proximal of said concentric end cap.

8. The structure set forth in claim 3, including a flow line connecting said first port to said second port and having valve means interposed therein for manipulating the respective stages to act as air springs, and said central hollow piston rod acting as an air accumulator.

9. The structure set forth in claim 3, wherein said end cap has a rotating shaft with a wound line attached through said central piston rod terminating wall, and including encoder means for automatically controlling the stroke of said cylinder.

10. The method of extending and retracting a telescoping cylinder responsive to the application of air under pressure comprising the steps of:

providing a cylindrical housing having an external cylindrical wall and end caps closing ends of said cylindrical wall;

forming a first stage for the extension and retraction of said telescoping cylinder by providing a central piston having a central opening facing said end cap together with a central hollow piston rod extending outwardly from said central piston opposite said end cap in axial alignment with said central opening and with said cylindrical wall;

providing a first compressed air port at a first end of said cylindrical wall adjacent one of said end caps and delivering air pressure across a face of said central piston and piston rod opposite said one of said end caps;

forming a second stage for the extension and retraction of said telescoping cylinder by providing a concentric piston and concentric piston rod having a hollow interior portion containing said central piston and central hollow piston rod respectively;

extending said telescoping cylinder by moving said central piston by supplying pressurized air to said first port sufficient to carry said piston rod to extended position initiating movement of said concentric piston and piston rod subjecting a face of said concentric piston to inlet air pressure; and relieving air from said cylinder during extension of said stages by successively venting same through a second compressed air port located at a second end of said cylindrical wall and straddling another of said end caps;

whereby said central piston and central piston rod are extended followed by extension of the concentric piston and concentric piston rod from the cylindrical wall, and retracting said telescoping cylinder by applying pressurized air to said second port whereby first said concentric piston and concentric piston rod are retracted followed by retraction of said central piston and central piston rod while air is exhausted through said first port.

11. The method set forth in claim 10, including the step of supplying air under pressure to a central recess in said one of said end caps.

12. The method set forth in claim 11, including the step of supplying air under pressure to said concentric and central pistons.

* * * * *